United States Patent [19]

Cirillo

[11] 4,376,318

[45] Mar. 15, 1983

[54] PORTABLE PLAYPEN

[76] Inventor: John R. Cirillo, 226 Kohr Rd., Kings Park, N.Y. 11754

[21] Appl. No.: 122,662

[22] Filed: Feb. 19, 1980

[51] Int. Cl.[3] ..... A47D 7/01; A47D 13/06

[52] U.S. Cl. ..... 5/99 C; 5/114

[58] Field of Search ..... 5/97, 98 R, 99, 100, 5/110, 112, 114

[56] References Cited

U.S. PATENT DOCUMENTS

| | | | |
|---|---|---|---|
| 1,417,253 | 5/1922 | Kibler, Jr. | 5/114 |
| 2,553,579 | 5/1951 | Harris | 5/99 C |
| 2,958,084 | 1/1960 | Kenny | 5/99 R |
| 3,183,528 | 5/1965 | Jacobs et al. | 5/99 R |
| 3,900,907 | 8/1975 | Mulder | 5/100 |
| 3,924,280 | 12/1975 | Vaiano | 5/99 R |

*Primary Examiner*—Alexander Grosz

*Attorney, Agent, or Firm*—Stanley Ira Laughlin

[57] ABSTRACT

A portable, foldable playpen having rectangular upper and lower frames to which a flexible enclosure is affixed and which folds along its end members when released by folding vertical members to form a compact arrangement.

2 Claims, 11 Drawing Figures

PORTABLE PLAYPEN

BACKGROUND OF THE INVENTION

The invention generally relates to playpens, and in particular to playpens that can be folded into compact arrangements for transporting such as described in Class 5, Subclass 99.

U.S. Pat. No. 2,624,054 to Plant describes a collapsible playpen having sides enploying scissor components which are held extended by removeable rails. The sides fold vertically when the rails are removed and are rotated to the horizontal position when carried.

U.S. Pat. No. 2,958,084 to Kenney describes a playpen in which the bottom is removed and the sides, comprised of slats positioned in the sewed pockets of fabric, are rolled up into a cylinder.

U.S. Pat. No. 3,924,280 to Vaiano describes a playpen employing a collapsible rectangular floor of triangles and quadrangles in a combination that can be lifted up to enable moving opposite sides together in a compact arrangement.

U.S. Pat. No. 4,008,499 to Wren et al describes a playpen employing spring-tensioned members that are drawn into a cylindrical member for ease of portability.

U.S. Pat. No. 4,070,716 to Satt et al is the closest prior art known to Applicant since this structure employes an upper rectangular frame that folds along its end members. However, Satt's structure differs from that of Applicant's because the sides of the upper frame also folds, thereby resulting in the structure folding vertically and requiring to be rotated into a horizontal position when being transported. In addition, the legs of the Satt structure are pivotally hinged at the inner center of the end members and diverges out to support the frame.

It is an object of Applicant's invention to provide a simple, safe and sturdy portable, foldable playpen.

It is an object of Applicant's invention to provide an economical and reliable playpen.

It is yet a further object of Applicant's invention to provide a compact portable, foldable playpen that is easily carried.

It is yet another further object of Applicant's invention to provide a portable, foldable playpen that comprises a single, non-separable unitary structure.

It is yet another further object of Applicant's invention to provide a foldable playpen that requires very few operator motions to open the playpen to its unfolded condition with ease, and fold the playpen as easily to its folded condition.

SUMMARY OF THE INVENTION

The invention relates to a portable, foldable playpen comprising upper and lower rectangular frames separated by vertical members and a flexible enclosure affixed to the frame, either completely or partially, for providing the sides and floor of the playpen. The end or side and vertical structural members fold inwardly when released by the vertical members to provide a compact arrangement for carrying.

DETAILED DESCRIPTION OF THE INVENTION

Figure 1:
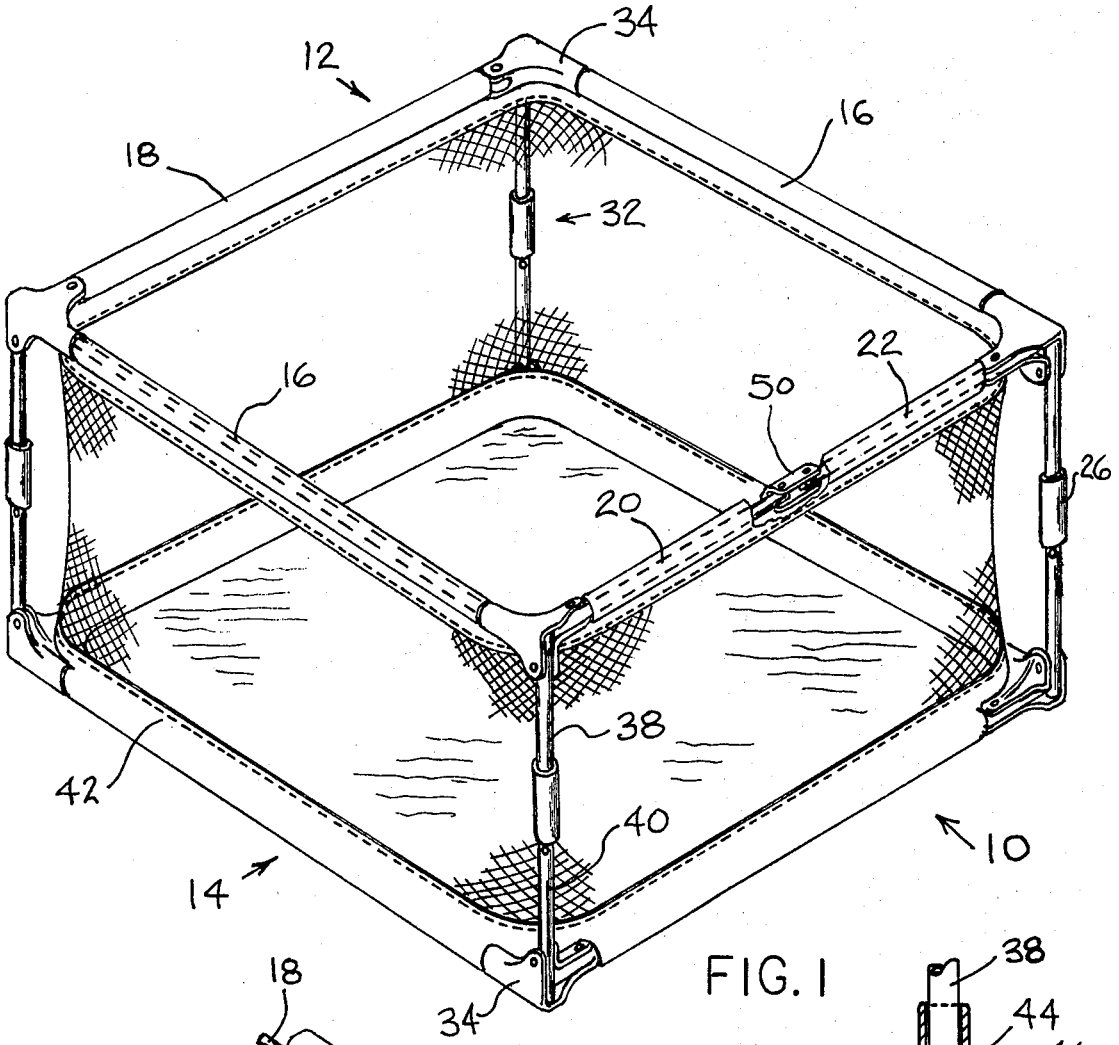
FIG. 1 is an isometric view of the applicant's invention when in the unfolded condition.
Figure 2:
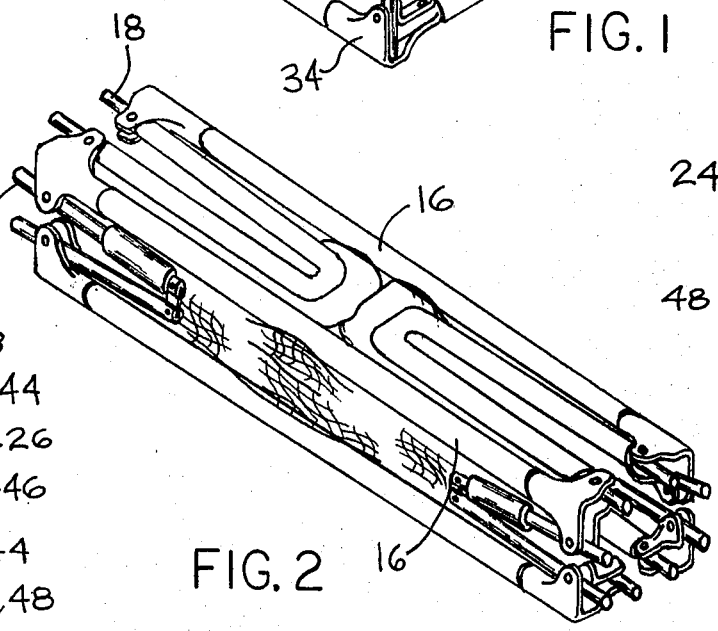
FIG. 2 is an isometric view of the applicant's invention shown in FIG. 1 when folded into a compact arrangement.
Figure 4:
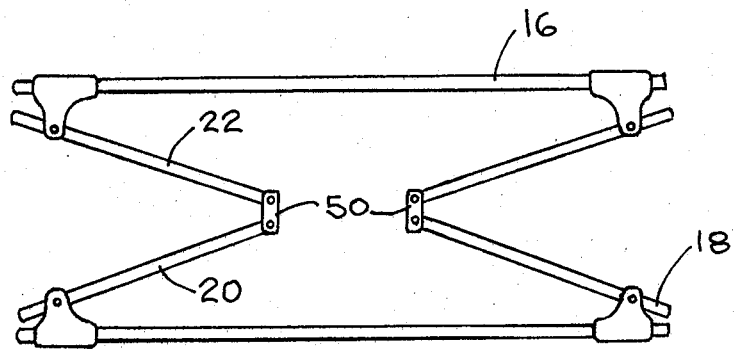
FIG. 4 is a plan view of applicant's invention shown in FIGS. 1 & 2 when partially folded.
Figure 7:
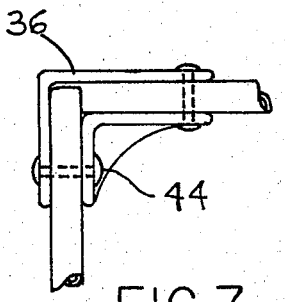
FIG. 7 is an end view of a detail of applicant's invention shown in FIGS. 1 & 2.
Figure 8:
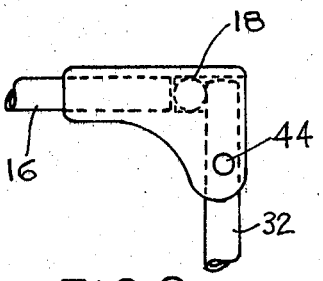
FIG. 8 is a side view of the detail of applicant's invention shown in FIG. 7.
Figure 9:
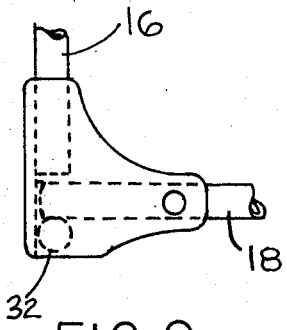
FIG. 9 is a plan view of the detail of applicant's invention shown in FIG. 7.

The applicant's inventive playpen, shown in the unfolded and useful condition in FIG. 1, and in the folded and stored or carrying condition in FIG. 2, comprises an upper frame 12, a lower frame 14, vertical members 32, and a flexible enclosure 42. Upper frame 12 comprises side members 16 and end members 18, as does lower frame 14. Side members 16 essentially consist of wood, plastic, metal or any combination of them, and are of one single or unitary structure; the terminals or ends of which terminate into, and are permanently affixed to a pivotable corner fitting 34, described in more detail hereafter. End members 18, also made of wood, plastic, metal or any combination thereof, comprises a plurality of sections indicated by reference numbers 20 and 22. The inner terminals of sections 20 and 22 are pivotally interconnected by conventional hinges 50 positioned so as to collapse said end members inwardly, thereby tending to draw side members 16 together into a substantially parallel and abutting arrangement as shown in FIG. 4. The outer terminals or ends of sections 20 and 22 are pivotally interconnected to side members 16 and vertical members 32 by pivotable corner fittings 34 and positioned in such a fashion so as to interlock the end members 18 thereby preventing the collapse of the end members 18 until after vertical members 32 are released for collapsing. Pivotable corner fittings 34, as shown in detail in FIGS. 7, 8 and 9 comprises means for pivotally pinning the outer terminals or ends of end and vertical members 18 and 32, such as may be implemented by the use of rivets. Although means for fastening the outer terminals or ends of side member 18 is shown, it would be just as feasible to interchange the side and end members so that the end members may be fastened, and the side members made to pivot providing the side members is also made to comprise pivoting inner sections. The interlocking of the outer end or terminal of end member sections 20 and 22 is implemented by positioning the end or terminal of the end member section behind the terminal or end of the vertical member section so that the vertical member section must be rotated around the pivot before the end member section can be rotated.

Figure 10:
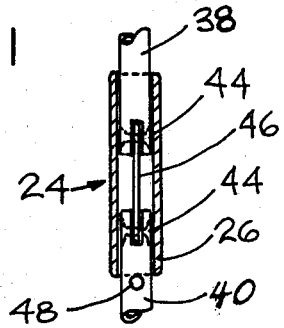
FIG. 10 is an end sectional view of another detail of applicant's invention shown in FIGS. 1 & 2.
Figure 11:
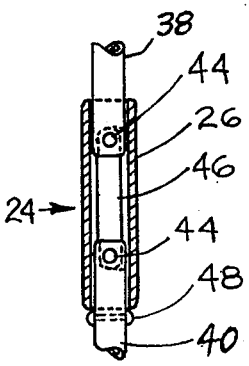
FIG. 11 is a side sectional view of the other detail of applicant's invention shown in FIG. 10.
Figure 3:
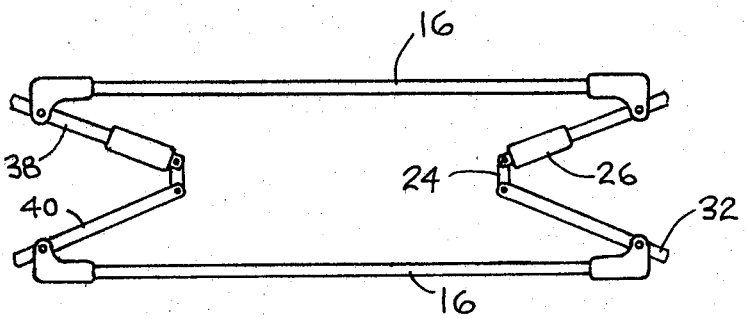
FIG. 3 is a side view of applicant's invention shown in FIGS. 1 & 2 when partially folded.
Figure 5:
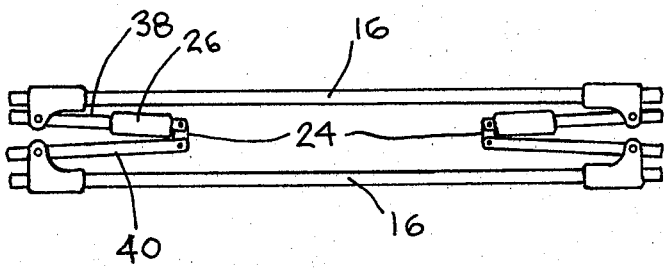
FIG. 5 is a side view of applicant's invention shown in FIG. 2.
Figure 6:
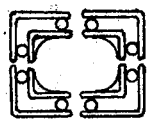
FIG. 6 is an end view of applicant's invention shown in FIG. 2.

Vertical members 32 are made of wood, plastic, metal or any combination similar to the construction of the side and end members and comprises a plurality of sections shown in this embodiment as two sections 38 and 40. The inner terminals or ends of sections 38 and 40 are pivotally interconnected by U-shaped hinge 24 which is shown in detail in FIGS. 10 and 11. Hinge 24 comprises pivoting pins or rivets 44 and a flat hinge 46 positioned so that vertical sections 38 and 40 collapse inwardly thereby tending to draw upper and lower frames 12 and 14 together into a substantially parallel and abutting arrangement as shown in FIG. 3. A moveable sleeve 26 slides over hinge 24 until stopped by sleeve stop 48 to prevent the collapsing of vertical sections 38 and 40 when the playpen is in its unfolded condition. Preventing any pivoting movement of hinge 24 prevents pivoting movement of the outer terminals or ends of vertical member 32 in pivotable corner fittings 34, and as stated in the foregoing paragraphs, this in turn prevents pivoting movement of the outer terminal or end of end member 18, and this in turn prevents pivoting movement of conventional hinge 50, thereby providing a safe and reliable structure when the playpen is in its unfolded condition. By moving sleeve 26 upwards clear of hinge 24, the pivoting inner terminals or ends of vertical sections 38 and 40 of vertical member 32 can be rotated inwardly, as shown in FIGS. 3 and 5, and this in turn will result in the outer terminals or ends of vertical member 32 to rotate around the pin or rivet pinning it to each pivotable corner fitting housing 36, and this in turn will bring upper and lower side members 16 closer together. As can be seen from reference to FIGS. 8 and 9, the outer terminals or ends of end member 18 will not be free to rotate when the inner terminals or ends of sections 20 and 22 are urged inwardly, as shown in FIG. 4. FIG. 6 shows an end view of the inventive playpen when the playpen is completely folded into its compact arrangement as shown in FIG. 2; the pivotable corner fittings standing out prominently along with the vertical and end members.

To open the inventive playpen, comprising in one embodiment two side members 16 and two end members 18 in each of its upper and lower frames 12 and 14, respectively, pivotally interconnected by eight corner fittings 34 to four vertical members 32, it is only necessary to extend the side members 16 of the upper and lower frames 12 and 14 until end members 18 are fully extended. After this is accomplished the upper and lower frames 12 and 14 are extended until vertical members 32 are fully extended and can be locked in this position by moving sleeve 26 over hinge 24 in each vertical member.

To close the foregoing embodiment of the inventive playpen, the sleeves 26 covering hinges 24 on each of the vertical members 32 are moved upwards until clear and free of hinges 24 and then the vertical sections 38 and 40 of the vertical members 32 are urged inwardly to lower upper frame 12. After this, conventional hinges 50 interconnecting end member sections 20 and 22 are urged inwardly permitting the side members of upper and lower frames 12 and 14 to come together to form the compact arrangement shown in FIG. 2.

The flexible enclosure 42 may essentially consist of a fabric or plastic, and may be in the form of a net or tightly woven material, with or without padding in the floor or frame areas. The enclosure may be affixed, either to the upper frame, either the side or end members, or both, or it may be fastened to both the upper and lower frames or any part thereof.

Although only one embodiment of the invention has been shown, applicant's invention is to be limited only by the breadth and scope of the annexed claims.

I claim:

1. A portable, foldable playpen (10) comprising upper (12) and lower (14) frames, each having a plurality of side (16) and end (18) members pivotally interconnected (34) with each other side (16) and end (18) members of said upper (12) frame positioned vertically above corresponding side (16) and end (18) members of said lower (14) frame, a flexible enclosure (42) attached to members of said frames, and vertical members (32) having pivotally interconnecting means with the pivotal interconnections (34) of the side (16) and end (18) members of said upper (12) and lower (14) frames, the inner ends of sections (38, 40) of the vertical members (32) and the inner ends of sections (20, 22) of the end members (18) in each of said upper (12) and lower (14) frames having pivotally interconnecting means (24, 50) for permitting, in cooperation with the upper (12) and lower (14) frames and the pivotal interconnections (34) of the vertical members (32), said upper (12) and lower (14) frame end (18) members and said vertical members (32) to be collapsed into substantially parallel and abutting arrangements relative to each other and relative to side (16) members, the pivotally interconnected means (24) of the vertical members with the pivotal interconnections (34, 50) of the side (16), end (18) members and vertical members (32) comprising locking and interlocking means for preventing the collapsing of the upper (12) and lower (14) frame end (18) members, until the pivotal interconnections (24) are collapsed, wherein when in an unfolded condition said upper (12) and lower (14) frames lying in substantially parallel planes with side (16) and end (18) members of the upper (12) frame aligned vertically with the respective side (16) and end (18) members of the lower (14) frame and the side (16) and end (18) members of the upper (12) and lower (14) frames being positioned orthogonally to the vertical members (32) to form an enclosed play area with said flexible enclosure (42), and when in a folded condition the pivotal interconnections (34) of the upper (12) and lower (14) frames side (16) and end (18) members with the vertical members (32), in cooperation with the pivotally interconnected inner ends of sections (20, 22) of the end (18) members in each of the upper (12) and lower (14) frames permit each of said upper (12) and lower (14) frame end (18) members to be collapsed into substantially parallel and abutting arrangements relative to each other and relative to side (16) members, and the pivotal interconnections (34) of the upper (12) and lower (14) frame side (16) and end (18) members with vertical members (32), in cooperation with the pivotally interconnected inner ends of sections (38, 40) of the vertical members (32) permit the side (16) members of each of the upper (12) and lower (14) frames not having any pivoting interconnections to be positioned substantially parallel to and in abutting arrangements relative to each other and relative to end (18) members and vertical members (32) to form a compact arrangement with said flexible enclosures (42).

2. A portable, foldable playpen as claimed in claim 1, wherein said locking and interlocking means for preventing the collapsing of the upper (12) and lower (14) frame end (18) members until the pivotal interconnections (24) are collapsed comprises moveable sleeves (26) which prevent any pivoting movement of pivotal interconnections (24), which in turn prevents any pivoting movement of the outer ends of the vertical members (32) in pivotally interconnections (34), which in turn prevents any pivoting movement of the outer ends of end (18) members in pivotally interconnections (34), which in turn prevents any pivoting movement of pivotally interconnections (50).

* * * * *